US007860441B2

(12) United States Patent
Matsumoto

(10) Patent No.: US 7,860,441 B2
(45) Date of Patent: Dec. 28, 2010

(54) FIXING BELT, FIXING DEVICE AND IMAGE FORMING APPARATUS

(75) Inventor: Hiroshi Matsumoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 913 days.

(21) Appl. No.: 11/703,168

(22) Filed: Feb. 7, 2007

(65) Prior Publication Data

US 2007/0280755 A1 Dec. 6, 2007

(30) Foreign Application Priority Data

May 30, 2006 (JP) ..... 2006-149479

(51) Int. Cl.
*G03G 15/20* (2006.01)

(52) U.S. Cl. ..... 399/329

(58) Field of Classification Search ..... 399/320, 399/328, 329

See application file for complete search history.

(56) References Cited

U.S. PATENT DOCUMENTS 7,027,763 B2 * 4/2006 Kato et al. ..... 399/329
7,236,716 B2 * 6/2007 Ishino et al. ..... 399/94

FOREIGN PATENT DOCUMENTS

JP 2002025759 A * 1/2002

OTHER PUBLICATIONS

Machine translation of JP 2002025759 A.*

* cited by examiner

*Primary Examiner*—David M Gray
*Assistant Examiner*—Barnabas T Fekete
(74) *Attorney, Agent, or Firm*—Finnegan, Henderson, Farabow, Garrett & Dunner, L.L.P.

(57) ABSTRACT

There is described a fixing device provided with a fixing belt, including a belt-shaped fixing member, which makes it possible to obtain a good image quality and an appropriate driving torque, by considering not only heights of the protrusions and depths of the depressions, but also widths of the protrusions and depressions included in an unevenness created on the inner circumferential surface of the belt-shaped fixing member. The maximum value of filtered waviness profile (W cm) of the unevenness is set at a value in a range of 0.8-10.0, while the profile bearing length (tp) of the unevenness, under 50% cutting level, is set in a range of 25%-70%. The fixing device also includes an rubbing member so that a lubricant agent is retained between the inner circumferential surface of the belt-shaped fixing member and the rubbing member.

16 Claims, 3 Drawing Sheets

FIXING BELT, FIXING DEVICE AND IMAGE FORMING APPARATUS

This application is based on Japanese Patent Application No. 2006-149479 filed on May 30, 2006 in Japanese Patent Office, the entire content of which is hereby incorporated by reference.

BACKGROUND OF THE INVENTION

The present invention relates to a fixing belt, which can easily retain lubricant agent on its surface so as to reduce the abrasion resistance, a fixing device provided with the abovementioned fixing belt, and an image forming apparatus provided with the abovementioned fixing device.

In an image forming apparatus, which employs the electrophotographic method, such as a copier, a printer, a facsimile, a compound apparatus provided with such the functions, a latent image corresponding to the document image is formed on a photoreceptor drum, and a toner image is developed by applying toner onto the latent image and the developed toner image is transferred onto a recording medium. Then, the transferred toner image is fixed onto the recording medium to eject the recording medium with the fixed toner image outside the apparatus.

Further, when forming a full color image, four latent images of unicolor images Y (Yellow), M (Magenta), C (Cyan), K (Black), corresponding to the document color image, are formed on the four photoreceptor drums, respectively. Then, the four developed unicolor toner images are primary transferred onto an endless-type intermediate transfer belt, and then, secondary transferred onto the recording medium. Successively, the transferred full color toner image is fixed onto the recording medium to eject the recording medium with the fixed full color toner image outside the apparatus.

As the abovementioned fixing device for fixing a toner image, there has been employed a heat roller type fixing device, which applies heat and pressure to the recording medium on which a toner image is already transferred, while tightly clipping and conveying the recording medium at a nip portion formed by making a fixing roller incorporating a heating element, such as a halogen lamp, etc., and a pressure roller for applying a pressure onto the fixing roller, press-contact each other. Since the structure of the fixing device of this type is relatively simple, such the fixing device has been widely employed in various kinds of image forming apparatuses.

Incidentally, in order to increase the fixing velocity of such the fixing device as mentioned in the above, it is necessary to supply a sufficient amount of heat to both the toner and the recording medium, and therefore, to widen the width of the nip portion. In order to widen the width of the nip portion, it could be considered to increase the pressing load applied to the fixing roller by the pressure roller, a thickness of the elastic layer made of silicon rubber, etc., formed on the pressure roller, or the diameters of both the fixing roller and the pressure roller.

However, when the pressing load or the thickness of the elastic layer of the pressure roller is increased, sometimes, the width of the nip portion in the axis direction becomes uneven, and this would possibly cause a fixing unevenness or a wrinkle of the recording medium. Further, when the diameters of the rollers are increased, there has been a problem that the fixing device not only is getting large-sized, but also requires a longer warming up time than ever.

To overcome the abovementioned problem, Patent Documents 1 and 2 (Tokkai 2005-173441, Tokkai 2001-341143, both are Japanese Non-Examined Patent Publications) set forth a fixing device, which is provided with: a fixing roller having an elastic layer made of a silicon rubber and rotating with a heating element, such as a halogen lamp, etc., incorporated at the center axial position of the fixing roller; an endless-type fixing belt circulating and driven by the fixing roller; and a pressing pad disposed at an inner circumferential surface side of the endless-type fixing belt, so as to press the endless-type fixing belt towards the fixing roller by means of the pressing pad.

According to the fixing device set forth in Patent Documents 1 and 2, the elastic deformation of the endless-type fixing belt pressed onto the fixing roller by the pressing pad creates a nip portion having a wide width between the fixing roller and the endless-type fixing belt. Accordingly, it becomes possible to cope with the high speed trend of the fixing device without increasing the size of the fixing device. Further, since the heat capacity of the endless-type fixing belt is relatively small, it becomes possible to shorten the warming up time, resulting in energy save.

In the fixing device set forth in Patent Documents 1 and 2, since the inner circumferential surface of the endless-type fixing belt rubs the fixed pressing pad while circulating, if no countermeasure is applied, there is a fear that deterioration of the fixed image quality due to the deviation of the endless-type fixing belt, increase of the power consumption of the motor for driving the endless-type fixing belt due to the increase of the driving torque of the endless-type fixing belt, failure of the speed reducing gear, abrasion of the inner circumferential surface of the endless-type fixing belt, etc. would occur, due to the large amount of the abrasion resistance between them. Accordingly, in order to reduce the abrasion resistance between the inner circumferential surface of the endless-type fixing belt and the fixed pressing pad, the fixing device is provided with a lubricant supplying member, which is made of sponge, etc. and press-contacts the inner circumferential surface of the endless-type fixing belt so as to supply lubricant agent on it. Further, an rubbing member, made of a low frictional material, is disposed between the endless-type fixing belt and the pressing pad.

However, even in the configuration mentioned in the above, since it is difficult for the inner circumferential surface of the endless-type fixing belt to stably retain the lubricant agent on it, depressions for retaining the lubricant agent in them, namely, appropriate degree of unevenness, are required to be formed on the inner circumferential surface of the endless-type fixing belt. Accordingly, in the fixing device set forth in Patent Document 1, the surface roughness of the inner circumferential surface of the endless-type fixing belt is defined by the arithmetical mean deviation of the profile (Ra), while, in the fixing device set forth in Patent Document 2, that is defined by the ten point height of irregularities (Rz).

Incidentally, the arithmetical mean deviation of the profile (Ra) can be derived from the steps of: extracting only the reference lengths from the roughness profile; totaling absolute values of the deviations from the average lines at the extracted portions to the measuring profile; and finding the arithmetical mean deviation by averaging the total absolute values. On the other hand, the ten point height of irregularities (Rz) can be derived from the steps of: extracting only the reference lengths from the roughness profile; averaging the absolute values of the peak heights of the five mountaintops from the highest to the fifth among all mountaintops from the average profile of the extracted portions; averaging the absolute values of the peak heights of the five mountaintops from the lowest to the fifth among all mountaintops from the average profile of the extracted portions; and calculating the ten point height of irregularities by adding the former average value and the latter average value to each other. The definitions of the abovementioned calculation procedures are detailed in the JIS B0601 (Japanese Industrial Standard B0601).

On the other hand, the present inventors have been intensively studied the relationship between the surface roughness of the inner circumferential surface of the fixing belt and the quality improvement of the fixed image and the reduction of the driving torque for the fixing belt. As a result of such the studies, the present inventors have found that the aforementioned definitions for the surface roughness are insufficient. Concretely speaking, even if the same value of the arithmetical mean deviation of the profile (Ra) is obtained with respect to different measurement cases, sometimes, the image quality and the driving torque varies in either a good case or a bad case, depending on the unevenness variation of the surface roughness. Accordingly, the present inventors have found that it is not a secure countermeasure to define the surface roughness of the inner circumferential surface of the fixing belt by employing the arithmetical mean deviation of the profile (Ra).

In other words, the arithmetical mean deviation of the profile (Ra) and the ten point height of irregularities (Rz) are derived by simply averaging heights of microscopic protrusions and depths of microscopic depressions residing on the surface, without taking expanses of the microscopic protrusions and the microscopic depressions into account. Accordingly, at a microscopic depression, since the lubricant agent protruded from the microscopic depression due to the interfacial force, it is difficult to securely retain the lubricant agent within the microscopic depression. Therefore, even if the arithmetical mean deviation of the profile (Ra) is the same as that in the good case, when the surface includes a lot of excessive microscopic depressions, it is difficult to retain the lubricant agent on the surface, and accordingly, the image quality and the driving torque are getting worse.

SUMMARY OF THE INVENTION

To overcome the abovementioned drawbacks in conventional fixing devices, it is an object of the present invention to provide a fixing belt, which makes it possible to obtain a good image quality and an appropriate driving torque, by considering not only heights of the protrusions and depths of the depressions, but also widths of the protrusions and depressions in regard to the surface roughness of the inner circumferential surface of the fixing belt so as to securely retain the lubricant agent, and further, to provide a fixing device provided with such the fixing belt, and an image forming apparatus provided with such the fixing device.

Accordingly, to overcome the cited shortcomings, the abovementioned object of the present invention can be attained by the fixing belts, the fixing devices and the image forming apparatus, described as follow.

(1) A fixing device for fixing a toner image, residing on a recording medium, onto the recording medium by applying heat and pressure onto both the toner image and the recording medium, comprising: a fixing member that includes a heater; a belt-shaped fixing member that is shaped in an endless belt and is rotated by a rotation of the fixing member; and a pressing member to press an inner circumferential surface of the belt-shaped fixing member toward the fixing member;

wherein the inner circumferential surface of the belt-shaped fixing member has an unevenness, and a maximum value of filtered waviness profile (W cm) of the unevenness is set at a value in a range of 0.8-10.0; and wherein a lubricant agent is retained between the inner circumferential surface of the belt-shaped fixing member and the pressing member.

(2) A fixing device for fixing a toner image, residing on a recording medium, onto the recording medium by applying heat and pressure onto both the toner image and the recording medium, comprising: a fixing member that includes a heater; a belt-shaped fixing member that is shaped in an endless belt and is rotated by a rotation of the fixing member; and a pressing member to press an inner circumferential surface of the belt-shaped fixing member toward the fixing member;

wherein the inner circumferential surface of the belt-shaped fixing member has an unevenness, and a profile bearing length (tp) of the unevenness, under 50% cutting level, is set in a range of 25%-70%; and wherein a lubricant agent is retained between the inner circumferential surface of the belt-shaped fixing member and the pressing member.

(3) An image forming apparatus having a fixing device to fix the toner image on the recording medium formed by an image forming section, the fixing device comprising: a fixing member that includes a heater; a belt-shaped fixing member that is shaped in an endless belt and is rotated by a rotation of the fixing member; and a pressing member to press an inner circumferential surface of the belt-shaped fixing member toward the fixing member;

wherein the inner circumferential surface of the belt-shaped fixing member has an unevenness, and a maximum value of filtered waviness profile (W cm) of the unevenness is set at a value in a range of 0.8-10.0; and wherein a lubricant agent is retained between the inner circumferential surface of the belt-shaped fixing member and the pressing member.

(4) An image forming apparatus having a fixing device to fix the toner image on the recording medium formed by an image forming section, the fixing device comprising: a fixing member that includes a heater; a belt-shaped fixing member that is shaped in an endless belt and is rotated by a rotation of the fixing member; and a pressing member to press an inner circumferential surface of the belt-shaped fixing member toward the fixing member;

wherein the inner circumferential surface of the belt-shaped fixing member has an unevenness, and a profile bearing length (tp) of the unevenness, under 50% cutting level, is set in a range of 25%-70%; and wherein a lubricant agent is retained between the inner circumferential surface of the belt-shaped fixing member and the pressing member.

(5) A fixing belt for fixing a toner image residing on a recording medium with heat and pressure, comprising: a belt-shaped fixing member that is shaped in an endless belt;

wherein an inner circumferential surface of the belt-shaped fixing member has an unevenness, and a maximum value of filtered waviness profile (W cm) of the unevenness is set in a range of 0.8-10.0.

(6) A fixing belt for fixing a toner image residing on a recording medium with heat and pressure, comprising: a belt-shaped fixing member that is shaped in an endless belt;

wherein an inner circumferential surface of the belt-shaped fixing member has an unevenness, and a profile bearing length (tp) of the unevenness, under 50% cutting level, is set in a range of 25%-70%.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
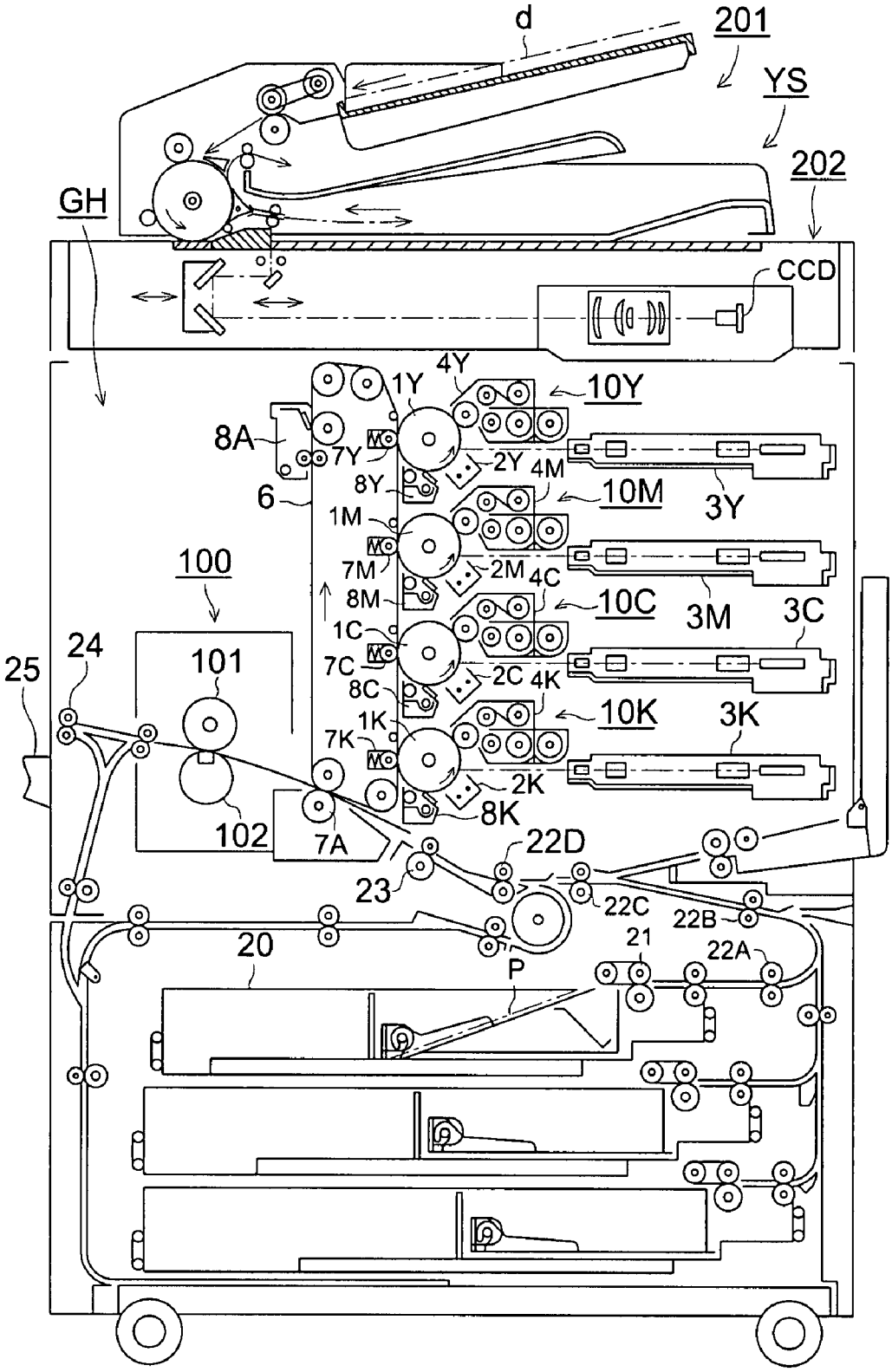
FIG. 1 shows a cross sectional schematic diagram of an image forming apparatus embodied in the present invention.

Referring to the drawings, with respect to an image forming apparatus, embodiments of the present invention will be detailed in the following.

Initially, referring to FIG. 1, an example of the image forming apparatus, embodied in the present invention, will be detailed in the following.

The image forming apparatus is constituted by an image forming apparatus proper GH and an image reading apparatus YS.

The image forming apparatus proper GH is called a tandem type color image forming apparatus, and is constituted by image forming sections 10Y, 10M, 10C, 10K, a belt-type intermediate transfer member 6, a paper feeding & conveyance section, a fixing device 9, etc.

The image reading apparatus YS, including an automatic document feeder 201 and a document image scanning & exposing apparatus 202, is disposed at an upper section of the image forming apparatus proper GH. A document D stacked on a document stacking tray of the automatic document feeder 201 is conveyed to an image reading position, at which an optical system of the document image scanning & exposing apparatus 20 exposes a single side or both sides of document D by scanning a light beam onto images on the document D, so as to reads the images by a line image sensor CCD.

In an image processing section, various kinds of image processing, such as an analogue processing, an analogue-to-digital conversion processing, a shading compensation processing, an image compression processing, etc., are applied to the image signals generated by photoelectronic converting actions performed in the line image sensor CCD, so as to output processed image data. Then, the processed image data are sent to exposing devices 3Y, 3M, 3C, 3K.

The image forming section 10Y for forming a toner image of color Y (Yellow) includes a photoreceptor drum 1Y, and further includes a charging device 2Y, an exposing device 3Y, a developing device 4Y, and a cleaning device 8Y, all of which are disposed at respective positions in the peripheral space around the circumferential surface of the photoreceptor drum 1Y. The image forming section 10M for forming a toner image of color M (Magenta) includes a photoreceptor drum 1M, and further includes a charging device 2M, an exposing device 3M, a developing device 4M, and a cleaning device 8M, all of which are disposed at respective positions in the peripheral space around the circumferential surface of the photoreceptor drum 1M. The image forming section 10C for forming a toner image of color C (Cyan) includes a photoreceptor drum 1C, and further includes a charging device 2C, an exposing device 3C, a developing device 4C, and a cleaning device 8C, all of which are disposed at respective positions in the peripheral space around the circumferential surface of the photoreceptor drum 1C. The image forming section 10K for forming a toner image of color K (Black) includes a photoreceptor drum 1K, and further includes a charging device 2K, an exposing device 3K, a developing device 4K, and a cleaning device 8K, all of which are disposed at respective positions in the peripheral space around the circumferential surface of the photoreceptor drum 1K.

The developing devices 4Y, 4M, 4C, 4K contain two components developer including carriers and small particle toner of colors Y (Yellow), M (Magenta), C (Cyan), K (Black), respectively.

The belt-type intermediate transfer member 6 is treaded on a plurality of rollers, so as to make it possible to circulate around them.

The fixing device 100 has a role for fixing a toner image residing on a recording medium P by applying heat and pressure to both the toner image and the recording medium currently passing through a nip portion formed between a fixing roller 101 heated and a fixing belt 102.

In the abovementioned construction of the image forming apparatus, the unicolor toner images of colors Y, M, C, K formed by the image forming section 10Y, 10M, 10C, 10K are sequentially transferred one by one onto the belt-type intermediate transfer member 6, which is currently circulating, by transferring units 7Y, 7M, 7C, 7K (primary transferring operation), so as to form a full color toner image synthesized on the belt-type intermediate transfer member 6. On the other hand, the recording medium P accommodated in a paper sheet feeding cassette 20 is picked up by a paper sheet feeding section 21 and conveyed to a transferring section 7A through paper sheet feeding rollers 22A, 22B, 22C, 22D and a registration roller 23, so as to transfer the full color toner image onto the recording medium P (secondary transferring operation). The fixing device 100 applies heat and pressure onto the recording medium P onto which the full color toner image is already transferred, so as to fix the full color toner image onto the recording medium P. Then, the recording medium P is tightly clipped by an ejecting roller 24, to eject the recording medium P onto an ejecting tray 25 disposed outside the apparatus.

Further, after the full color toner image is transferred onto the recording medium P by the transferring section 7A, the recording medium P is separated from the belt-type intermediate transfer member 6 by a curvature separating action. Then, the residual toner remaining on the surface of the belt-type intermediate transfer member 6 are removed by a cleaning unit 8A.

Incidentally, although the image forming apparatus for forming a color image has been described in the foregoing, an image forming apparatus for forming a monochrome image is also applicable in the present invention, and further, an image forming apparatus having no intermediate transfer member is also applicable in the present invention.

Next, referring to a cross sectional schematic diagram shown in FIG. 2, and an enlarged cross sectional schematic diagram shown in FIG. 3, the fixing device 100 embodied in the present invention will be detailed in the following.

The fixing roller 101 is constituted by a cylindrical core metal 101A, which is made of a metal material, such as aluminum, iron, etc., and includes a heat source, such as halogen lamp, etc., an elastic layer 101B, which is made of a silicon rubber having a high heat resistivity and with which the outer circumferential surface of the cylindrical core metal 101A is coated, and a separation layer 101C, which is made of fluororesin, such as a PFA (perfluoroalkoxy), a PTFE (polytetrafluoro-ethylene), etc., and with which the outer circumferential surface of the elastic layer 101B is further coated.

The fixing belt 102 is constituted by a base substrate made of a polyimide sheet having a thickness of about 100 μm, and a separation layer, which is made of a PFA or a PTFE having a thickness of about 25 μm and with which the outer surface of the base substrate is coated. Further, the fixing belt 102 is shaped in an endless belt.

A pressing pad 103 made of a silicon rubber having a JISA hardness of about 10°, is supported by a holder 108 made of a heat resistive resin, while putting a base plate 104 made of a stainless steel, and a base member 105 made of a heat resistive resin, between them. Further, a compression spring 106 is disposed at the backside of the base member 105.

Hereinafter, the structural configuration including the pressing pad 103, the base plate 104, the base member 105 and the compression spring 106 is called a pressing section.

Further, a separation member 107, for improving the separation-ability of the recording medium P on which the toner image is already fixed, is made of a heat resistive resin or a metal material, such as aluminum, etc., and is supported by the holder 108 and a holder 109 made of a heat resistive resin.

Still further, the holder 108 and the holder 109 is supported by a metal frame 110.

An rubbing member 111, made of a glass fiber sheet coated with a Teflon (Registered Trade Mark) or a PTFE sheet, is inserted between the inner circumferential surface of the fixing belt 102 and the pressing pad 103, and between the inner circumferential surface of the fixing belt 102 and the separation member 107. In addition, one end of the rubbing member 111 is fixed onto the metal frame 110.

An oil pad 112, serving as a lubricant agent supplying member and made of a sponge material, etc., contains a lubricant agent, such as silicon oil, etc., and press-contacts the inner circumferential surface of the fixing belt 102.

In the fixing device 100 as structured in the above, the fixing roller 101, heated by the halogen lamp H and driven by a driving section (not shown in the drawings), rotates in a clockwise direction. Further, the pressing pad 103 is urged by the compression spring 106 through the base plate 104 and the base member 105, and as a result, presses the fixing belt 102 against the fixing roller 101 while putting the rubbing member 111 between the pressing pad 103 and the fixing belt 102. Further, the holder 109, pressed by the metal frame 110, presses the fixing belt 102 against the fixing roller 101 through the rubbing member 111, as shown in FIG. 3.

Accordingly, corresponding to the rotation of the fixing roller 101, the fixing belt 102 rotates in an anticlockwise direction. Further, since the fixing belt 102 is pressed against the fixing roller 101 by the pressing pad 103 so as to elastically deform the fixing belt 102, a nip portion N, having a wider width, is formed between the fixing belt 102 and the fixing roller 101.

Further, although the rubbing member 111 abrasively rubs the inner circumferential surface of the fixing belt 102 during the time when the fixing belt 102 is circulating, an abrasion resistivity between them is relatively small, since the friction coefficient of the rubbing member 111 is small. Further, a lubricant agent, such as silicon oil, etc., is supplied onto the inner circumferential surface of the fixing belt 102, and the lubricant agent is retained as a thin film between the fixing belt 102 and the rubbing member 111.

Incidentally, in the fixing device, which does not includes the rubbing member 111, the lubricant agent is retained as a thin film between the fixing belt 102, and the pressing pad 103 and the holder 109.

Since the inner circumferential surface of the fixing belt 102 is finished at an appropriate surface roughness, as detailed later, it is possible to keep securely retaining the lubricant agent. Accordingly, there is no possibility that the quality degradation of the fixed image due to the deviation of the fixing belt, the increase of the power dissipation of the motor for driving the fixing belt due to the increase of the driving torque, etc. would occur.

Next, the experimental results with respect to the subject of "variations of quality of the fixed image and torque for driving the fixing belt corresponding to variations of surface roughness of the inner circumferential surface of the fixing belt" will be indicated in the following.

(1) Experimental Conditions

Figure 2:
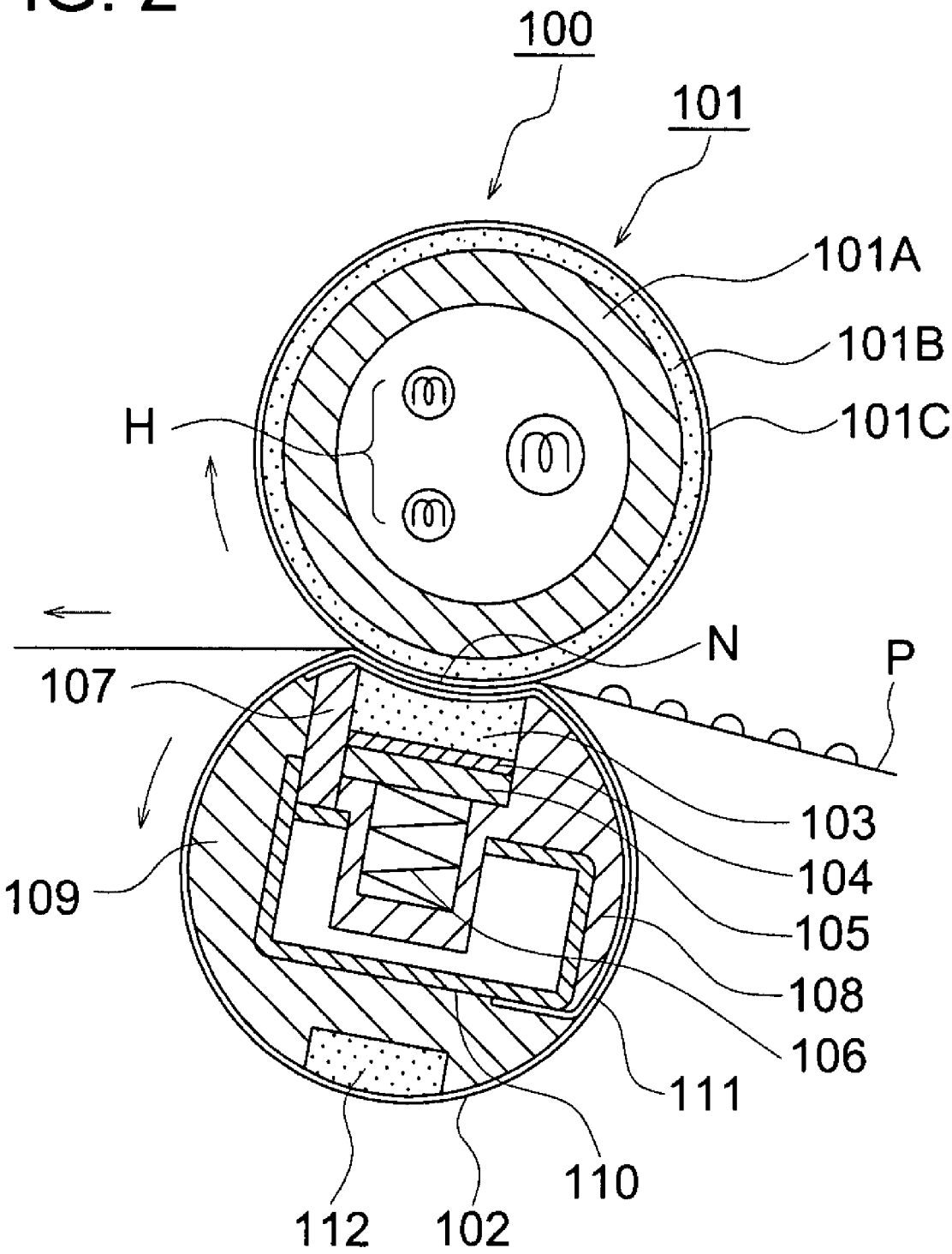
FIG. 2 shows a cross sectional schematic diagram of a fixing device embodied in the present invention.
Figure 3:
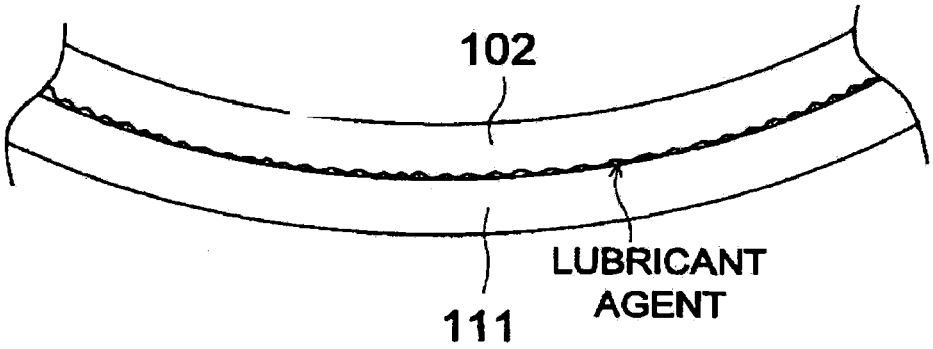
FIG. 3 shows an enlarged cross sectional schematic diagram indicating a main part of a fixing device embodied in the present invention.

Configuration of the fixing device: same as that shown in FIG. 2.

Fixing belt: made of polyimide resin and coated with PTFE, outer diameter; 35 mm, width; 390 mm, thickness; 125 μm (includes a surface layer), circumferential velocity; 350 mm/s.

Rubbing member: made of glass fiber sheet coated with Teflon (Registered Trade Mark).

Lubricant agent: dimethyl silicon oil.

(2) Evaluations

Image quality: Good; no problem, Passable; within an acceptable level, Bad; unacceptable defect.

Driving torque for a target torque: Excellent; smaller than 50%, Good; equal to or greater than 50% and smaller than 70%, Passable; equal to or greater than 70% and smaller than 80%, Bad; equal to or greater than 80%.

(3) Results of Experiments

Results 1

The variations of quality of the fixed image and the variations of driving torque were found by varying the maximum value of filtered waviness profile (W cm), representing as the surface roughness of the inner circumferential surface of the fixing belt. Further, the arithmetical mean deviations of the profile (Ra) were also found as the reference data.

Incidentally, the maximum value of filtered waviness profile (W cm) represents waviness profile components including large up-and-down waving slopes, which is derived from a cross sectional profile acquired by measuring the unevenness of the surface concerned and by removing fine unevenness components, namely, short wave components, with a low pass filter. The details of the above are defined by the JIS B0601 (Japanese Industrial Standard).

The detail of the filtered waviness profile (W cm) is also defined in the ISO 4287.

The experimental results are indicated in Table 1.

TABLE 1

| W cm | Quality of fixed image | Driving torque | Ra μm |
|---|---|---|---|
| 0.5 | Passable | Passable | 0.6 |
| 0.6 | Passable | Passable | 0.8 |
| 0.8 | Good | Excellent | 0.8 |

TABLE 1-continued

| W cm | Quality of fixed image | Driving torque | Ra μm |
|---|---|---|---|
| 2.0 | Good | Excellent | 0.8 |
| 0.9 | Good | Excellent | 0.9 |
| 1.5 | Good | Excellent | 0.9 |
| 2.5 | Good | Excellent | 1.0 |
| 3.0 | Good | Excellent | 1.1 |
| 3.2 | Good | Good | 1.1 |
| 9.2 | Good | Good | 3.0 |
| 10.2 | Passable | Passable | 3.2 |
| 11.0 | Bad | Bad | 2.8 |

Results 2

The variations of quality of the fixed image and the variations of driving torque were found by varying the profile bearing length (tp), representing as the surface roughness of the inner circumferential surface of the fixing belt. Further, the arithmetical mean deviations of the profile (Ra) were also found as the reference data.

Incidentally, the profile bearing length (tp) is a percentage value representing a ratio of the sum of the cut lengths, acquired by cutting a part of the roughness profile corresponding to a reference length, which is extracted from the roughness profile, with a cutting level being parallel to the peak line, and the reference length. The details of the above are defined by the JIS B0601 (Japanese Industrial Standard).

The profile bearing length (tp) is also referred to as the relative material ratio (tp) as defined in the ISO (International Standard Organization) 4287. Further, the detail of the relative material ratio (tp) is also defined in the ISO 4287.

In this experiments, 50% cutting level is employed for evaluations.

The experimental results are indicated in Table 2.

TABLE 2

| tp | Quality of fixed image | Driving torque | Ra μm |
|---|---|---|---|
| 20 | Passable | Passable | 0.6 |
| 24 | Passable | Passable | 0.8 |
| 25 | Good | Excellent | 0.8 |
| 28 | Good | Excellent | 0.8 |
| 30 | Good | Excellent | 0.9 |
| 35 | Good | Excellent | 0.9 |
| 45 | Good | Excellent | 1.0 |
| 55 | Good | Excellent | 1.1 |
| 62 | Good | Good | 1.1 |
| 68 | Good | Good | 3.0 |
| 74 | Passable | Passable | 3.2 |
| 76 | Bad | Bad | 2.8 |

(4) Considerations

In both Results 1 and Results 2, when the maximum value of filtered waviness profile (W cm) or the profile bearing length (tp) is small, since the depressions are too small to sufficiently retain the lubricant agent in them, it becomes difficult to retain the lubricant agent, and therefore, the abrasion resistance of the fixing belt increases. Accordingly, the increase of the torque for circulating the fixing belt causes rotation unevenness, resulting in unevenness of the conveyance velocity of the recording medium on which the toner image is to be fixed, and this results in a defect of the image quality. On the other hand, when the maximum value of filtered waviness profile (W cm) or the profile bearing length (tp) is large, since a portion capable of retaining the lubricant agent and another portion incapable of retaining the lubricant agent are excessively apart from each other, the abrasion resistance of the fixing belt increases, as well as the above. Accordingly, the increase of the torque for circulating the fixing belt causes rotation unevenness, resulting in unevenness of the conveyance velocity of the recording medium on which the toner image is to be fixed, and this causes a defect of the image quality.

When the maximum value of filtered waviness profile (W cm) is set at an appropriate value, since a moderate waviness is formed on the inner circumferential surface of the fixing belt and the lubricant agent can be retained in its depressed portions, the abrasive surface enters into nearly a state of fluid lubrication, resulting in decrease of the abrasion resistivity.

Further, when the profile bearing length (tp) is set at an appropriate value, since an area ratio of depressed portions included in the inner circumferential surface of the fixing belt and the lubricant agent can be retained in such the depressed portions, the abrasive surface enters into nearly a state of fluid lubrication, resulting in decrease of the abrasion resistivity.

According to the foregoing, it is preferable that the maximum value of filtered waviness profile (W cm) is in a range of 0.8-10.0, and it is more preferable in a range of 0.8-10.0. Further, it is preferable that the profile bearing length (tp) is in a range of 25%-70% and it is more preferable in a range of 25%-60%.

Incidentally, according to the experiments mentioned in the above, even if the arithmetical mean deviations of the profile (Ra) calculated in plural cases coincide with each other, each of the evaluations for the quality of the fixed image and the driving torque results in either Good or Bad. Accordingly, it has been revealed that it is not secure to define the inner circumferential surface of the fixing belt only with the arithmetical mean deviations of the profile (Ra).

Further, in the present experiments, although the circumferential velocity of the fixing belt is made to vary in a range of 100-500 mm/sec, the changes of the circumferential velocity did not influence the results of the experiments mentioned in the above.

Finally, various kinds of methods for manufacturing the fixing belt will be detailed in the following. It is possible to fulfill the abovementioned conditions by employing any one of the manufacturing methods indicated in the following.

Manufacturing Method 1

The abrasive blasting, in which ball-shaped particles, such as glass particles, etc., are blasted with compressed air, is applied to the cylinder-shaped core body (metal mold), so as to create the surface roughness for which the maximum value of filtered waviness profile (W cm) and the profile bearing length (tp) respectively enter into the abovementioned ranges. Then, the polyimide resin is applied onto the cylinder-shaped core body. After the polyimide resin film is formed through the drying and baking processes, the polyimide resin film is removed from the mold.

Manufacturing Method 2

The abrasive blasting is applied to the cylinder-shaped core body mentioned in the above, to an extent that its surface roughness becomes rougher than the target surface roughness. After the polyimide resin film is formed through the drying and baking processes, the polyimide resin film is removed from the mold, as well. Then, the machining process is applied to its inner circumferential surface, so as to create the surface roughness for which the maximum value of filtered waviness profile (W cm) and the profile bearing length (tp) respectively enter into the abovementioned ranges.

Manufacturing Method 3

The polyimide resin is applied onto the cylinder-shaped core body to which no abrasive blasting is applied. After the polyimide resin film is formed through the drying and baking processes, the machining process is applied to its outer circumferential surface, so as to create the surface roughness for which the maximum value of filtered waviness profile (W cm) and the profile bearing length (tp) respectively enter into the abovementioned ranges. Then, the polyimide resin film is removed from the mold by turning its inside out.

Manufacturing Method 4

By employing the centrifugation method, the polyimide resin is applied onto inner circumferential surface of the cylinder-shaped core body to which no abrasive blasting is applied. After the polyimide resin film is formed through the drying and baking processes, the machining process is applied to its inner circumferential surface, so as to create the surface roughness for which the maximum value of filtered waviness profile (W cm) and the profile bearing length (tp) respectively enter into the abovementioned ranges.

While the preferred embodiments of the present invention have been described using specific term, such description is for illustrative purpose only, and it is to be understood that changes and variations may be made without departing from the spirit and scope of the appended claims.

What is claimed is:

1. A fixing device for fixing a toner image, residing on a recording medium, onto the recording medium by applying heat and pressure onto both the toner image and the recording medium, comprising:

a fixing member that includes a heater;

a belt-shaped fixing member that is shaped in an endless belt and is rotated by a rotation of the fixing member; and a pressing member to press an inner circumferential surface of the belt-shaped fixing member toward the fixing member;

wherein the inner circumferential surface of the belt-shaped fixing member has an unevenness, and a maximum value of filtered waviness profile (W cm) of the unevenness is set at a value in a range of 0.8-10.0; and wherein a lubricant agent is retained between the inner circumferential surface of the belt-shaped fixing member and the pressing member.

2. The fixing device of claim 1, wherein the maximum value of filtered waviness profile (W cm) of the unevenness is set in a range of 0.8-3.0.

3. The fixing device of claim 1, further comprising:

a lubricant agent supplying member that contains the lubricant agent and press-contacts the inner circumferential surface of the belt-shaped fixing member.

4. The fixing device of claim 1, further comprising:

an rubbing member disposed between the pressing member and the belt-shaped fixing member;

wherein the lubricant agent is retained between the inner circumferential surface of the belt-shaped fixing member and the rubbing member.

5. A fixing device for fixing a toner image, residing on a recording medium, onto the recording medium by applying heat and pressure onto both the toner image and the recording medium, comprising:

a fixing member that includes a heater;

a belt-shaped fixing member that is shaped in an endless belt and is rotated by a rotation of the fixing member; and a pressing member to press an inner circumferential surface of the belt-shaped fixing member toward the fixing member;

wherein the inner circumferential surface of the belt-shaped fixing member has an unevenness, and a profile bearing length (tp) of the unevenness, under 50% cutting level, is set in a range of 25%-70%; and wherein a lubricant agent is retained between the inner circumferential surface of the belt-shaped fixing member and the pressing member.

6. The fixing device of claim 5, wherein a profile bearing length (tp) of the unevenness, under 50% cutting level, is set in a range of 25%-60%.

7. The fixing device of claim 5, further comprising:

a lubricant agent supplying member that contains the lubricant agent and press-contacts the inner circumferential surface of the belt-shaped fixing member.

8. The fixing device of claim 5, further comprising:

an rubbing member disposed between the pressing member and the belt-shaped fixing member;

wherein the lubricant agent is retained between the inner circumferential surface of the belt-shaped fixing member and the rubbing member.

9. An image forming apparatus having a fixing device to fix the toner image on the recording medium formed by an image forming section the fixing device comprising:

a fixing member that includes a heater;

a belt-shaped fixing member that is shaped in an endless belt and is rotated by a rotation of the fixing member; and a pressing member to press an inner circumferential surface of the belt-shaped fixing member toward the fixing member;

wherein the inner circumferential surface of the belt-shaped fixing member has an unevenness, and a maximum value of filtered waviness profile (W cm) of the unevenness is set at a value in a range of 0.8-10.0; and wherein a lubricant agent is retained between the inner circumferential surface of the belt-shaped fixing member and the pressing member.

10. The image forming apparatus of claim 9, wherein the maximum value of filtered waviness profile (W cm) of the unevenness is set in a range of 0.8-3.0.

11. An image forming apparatus having a fixing device to fix the toner image on the recording medium formed by an image forming section the fixing device comprising:

a fixing member that includes a heater;

a belt-shaped fixing member that is shaped in an endless belt and is rotated by a rotation of the fixing member; and a pressing member to press an inner circumferential surface of the belt-shaped fixing member toward the fixing member;

wherein the inner circumferential surface of the belt-shaped fixing member has an unevenness, and a profile bearing length (tp) of the unevenness, under 50% cutting level, is set in a range of 25%-70%; and wherein a lubricant agent is retained between the inner circumferential surface of the belt-shaped fixing member and the pressing member.

12. The image forming apparatus of claim 11, wherein a profile bearing length (tp) of the unevenness, under 50% cutting level, is set in a range of 25%-60%.

13. A fixing belt for fixing a toner image residing on a recording medium with heat and pressure, comprising:

a belt-shaped fixing member that is shaped in an endless belt;

wherein an inner circumferential surface of the belt-shaped fixing member has an unevenness, and a maximum value of filtered waviness profile (W cm) of the unevenness is set in a range of 0.8-10.0.

14. The fixing belt of claim 13, wherein the maximum value of filtered waviness profile (W cm) of the unevenness is set at a value in a range of 0.8-3.0.

15. A fixing belt for fixing a toner image residing on a recording medium with heat and pressure, comprising:

a belt-shaped fixing member that is shaped in an endless belt;

wherein an inner circumferential surface of the belt-shaped fixing member has an unevenness, and a profile bearing length (tp) of the unevenness, under 50% cutting level, is set in a range of 25%-70%.

16. The fixing belt of claim 15, wherein the profile bearing length (tp) of the unevenness, in 50% cutting level, is set at a value in a range of 25%-60%.

* * * * *